United States Patent [19]

Augustin, Friedehelm et al.

[11] 4,048,927

[45] Sept. 20, 1977

[54] PLANT FOR BURNING WASTE

[75] Inventors: Heinz Mallek; Werner Jablonski, both of Tetz; and Friedhelm Augustin, Julich, all of Germany

[73] Assignee: Kernforschungsanlage Julich Gesellschaft mit beschrankter Haftung, Julich, Germany

[21] Appl. No.: 612,475

[22] Filed: Sept. 11, 1975

[30] Foreign Application Priority Data

Sept. 14, 1974 Germany ..... 2444125

[51] Int. Cl.[2] ..... F23G 5/00; F23L 17/00

[52] U.S. Cl. ..... 110/8 R; 110/17; 110/84

[58] Field of Search ..... 110/8 R, 8 B, 11, 17, 110/18 R, 84, 26, 27

[56] References Cited

U.S. PATENT DOCUMENTS

| | | | |
|---|---|---|---|
| 1,776,914 | 9/1930 | Langford | 110/18 |
| 2,869,487 | 1/1959 | Sherman | 110/84 |
| 3,303,798 | 2/1967 | Kartinen et al. | 110/11 |
| 3,807,322 | 4/1974 | Liw et al. | 110/17 |
| 3,841,239 | 10/1974 | Nakamura | 110/17 |

*Primary Examiner*—Kenneth W. Sprague
*Attorney, Agent, or Firm*—Walter Becker

[57] ABSTRACT

A plant for burning waste which has a main combustion chamber to be charged with the waste to be burnt and with fresh gases for burning the waste. From this main combustion chamber the burnt material and unburnt residual material including gases pass through a grate into a post-combustion chamber, the bottom of which is adapted to be closed, and which has lateral outlets for the waste gas. The post-combustion chamber which has a volume at least equalling the volume of the main combustion chamber has a wall structure extending from above into said post-combustion chamber for guiding gases passing through the grate toward the bottom of the post-combustion chamber. This wall structure is open at its lower end and is of highly heat resistant material as e.g. steel. The post-combustion chamber has a waste gas outlet through which the waste gas from the post-combustion chamber is discharged after it has, prior thereto, been purified by passing through filters between an outer wall and inner wall of the post-combustion chamber.

12 Claims, 1 Drawing Figure

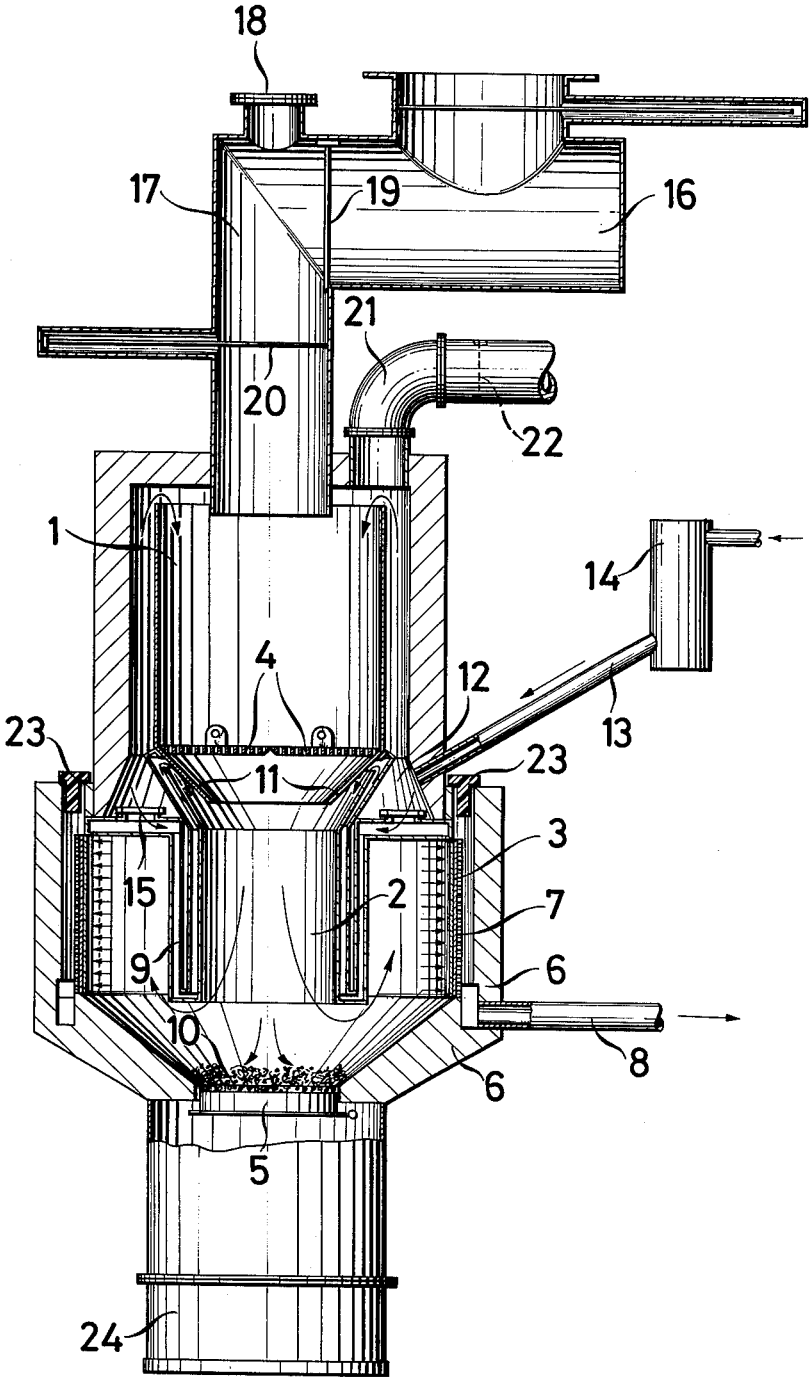
18
17
19
16
21
20
22
1
14
4
12
13
23
11
23
3
15
2
7
9
6
10
8
6
5
24

PLANT FOR BURNING WASTE

The present invention relates to a plant for burning waste, which plant primarily comprises an inlet section leading into the upper portion of said plant for the main combustion chamber which receives fresh gases for the combustion of the waste, said inlet section having its lower end defined by a grate. The plant furthermore comprises a post-combustion chamber which is arranged below said main combustion chamber, and also includes a device for purifying the waste gases.

Plants for burning waste are employed in order to considerably reduce the volume of burnable waste materials of different composition as, for instance, synthetic materials, dead animals, waste from clinics and hospitals or, in order to reduce waste materials contaminated by radioactive substances, and also in order to obtain sterile non-burnable residues. In this connection, endeavors are made to purify flue gases generated during the combustion, before releasing said flue gases into the atmosphere, from substances which may be harmful to the environment.

If waste gases are to be burned which are contaminated by radioactive substances, incinerators are required which will make it possible to carry out a burning of such waste without endangering the health of the service personnel. Complicated plants in which the servicing personnel may come into contact with contaminated surfaces are not suitable for burning radioactive wastes.

A plant for burning waste which is intended for burning radioactive waste has become known. This known plant comprises a waste ashing-muffle furnace which is followed by a device for purifying the waste gases. The waste gas ashing-muffle furnace comprises a main combustion chamber which has its lower end defined by a grate, and into which fresh gases are introduced for the combustion. The said muffle furnace furthermore comprises a post-combustion chamber arranged below the grate while a plurality of grates are arranged in said post-combustion chamber. A flue gas passage for the flue gases passed into the post-combustion chamber leads into the upper portion of the post-combustion chamber. The above outlined arrangement has the drawback that the flue gases as well as the waste parts which pass through the grate arranged at the bottom portion of the main combustion chamber cannot be sufficiently long post-burned. The solid and gaseous residues obtained during the combustion are therefore not sufficiently free from burnable components.

It is, therefore, an object of the present invention to provide a plant for burning waste, which plant will make it possible to obtain residues which are sufficiently free from burnable components.

It is a further object of this invention to provide a plant as set forth in the preceding paragraph which is simple in construction, simple to service, and at the same time does not endanger the lives of the service personnel and can also be serviced even when waste contaminated by radioactive substances are being burned.

This object and other objects and advantages of the invention will appear more clearly from the following specification, in connection with the accompanying drawing diagrammatically illustrating a plant according to the present invention.

The plant according to the present invention is characterized primarily in that the post-combustion chamber is designed as a combustion chamber which is adapted to be closed at its lower end and which is equipped with outlets for the waste gases, which outlets are arranged laterally in the outer wall of said post-combustion chamber, said post-combustion chamber having a size which corresponds at least to the size of the main combustion chamber. The plant according to the invention is furthermore characterized in that within the post-combustion chamber there is provided an inner wall of highly heat resistant material such as steel, which inner wall extends from above into said post-combustion chamber and is adapted to convey gases passing through the grate to the bottom of the post-combustion chamber which the lower end of said inner wall is open.

By moving the grate which expediently consists of parts movable toward each other, the ashes on the grate are sifted while ash particles which may in part contain unburned residues drop onto the bottom of the post-combustion chamber. Here these residues are post burned in an effective manner, inasmuch as they are hit by the hot gases which consist of the flue gases formed during the combustion in the main combustion chamber. The combustion is aided furthermore by the fact that the ash bed on the bottom of the post-combustion chamber has a thin and simultaneously large surface. Furthermore, the ash bed is always opened up again by the ash parts which drop from above whereby the combustion is aided. Due to the fact that the flue gases are conveyed to the bottom through the inner wall of the post-combustion chamber and only from the bottom pass into the intermediate space of the post-combustion chamber which intermediate space is formed by the inner and outer wall, and from said intermediate space pass to the outlets in the outer wall, it will be assured that the flue gases remain for a sufficiently long time in the post-combustion chamber and in this way are sufficiently post burned. The post combustion of the flue gases is advantageously aided further by the fact that for purposes of whirling of the gases flowing into the post-combustion chamber, in the upper portion of the inner chamber defined by the inner wall there are provided guiding plates which narrow said inner chamber. Furthermore, for aiding the post combustion, it is expedient that the post-combustion chamber includes a feeding path for the fresh gases which leads into the upper portion of the inner chamber defined by the inner wall. The whirling of the gases which is favorable for the post-combustion is additionally improved by the delivery of the fresh gases into the inner chamber of the combustion chamber below the guiding plates.

A further advantageous design of the plant according to the invention consists in that the feeding passage which leads into the interior of the post-combustion chamber is arranged as a delivery guided in countercurrent flow in the inner wall of said post-combustion chamber, and that the wall of the main combustion chamber is a double wall having an inner wall of high heat-resistant material, of steel, or the like. The delivery for the fresh gases which leads into the upper portion of the main combustion chamber is arranged within the wall in such a way that the fresh gases are conveyed from below upwardly through the wall. In this way, a preheating of the fresh gases conveyed into the two chambers is obtained and simultaneously a cooling of the inner wall of the post-combustion chamber and of the inner part of the double wall of the main combustion chamber. Inasmuch as the gases with this arrangement of the delivery are conveyed approximately at the level of the grate to that portion of the plant which comprises the main and post-combustion chambers, it is possible to feed the fresh gases fed to the main and post-combustion chambers, together into an annular gas conduit which is arranged approximately at the level of the grate outside the two chambers. This permits a compact construction of this portion of the plant.

It is advantageous to design the grate as a pivotal grate which comprises at least two parts that are respectively rotatable about an axis and which are pivotal toward the wall of the main combustion chamber. Such an arrangement makes it possible that by pivoting the grate, the passage between the main combustion chamber and the post-combustion chamber is opened so that during the cleaning of the plant also the post combustion chamber will be accessible from above. An expedient design of the parts of the grate consists in that the parts of the grate are designed as intermeshing parts. In this way, it is possible in a simple manner by pivoting the parts or sections of the grate to loosen up the ash bed.

As a device for purifying the waste gases which are connectable to the plant sections comprising the main and post-combustion chambers, heretofore known devices may be used, such as cyclones, electrofilters, bag filters, filter candles, or other devices, according to which the purification of the gases is effected by web purification. It has proved particularly advantageous for purposes of purifying the waste gases to provide filters on the inside of the outlets provided in the outer wall of the post-combustion chamber. As filter elements, there may be employed, for instance, porous plates of high heat-resistant steel or elements or ceramic materials.

Due to the filters arranged on the inside of the outlets, as and soot particles which are carried along by the waste gases in a floating condition, are retained and are deposited on the inside of the filter without clogging up the filter by the deposited particles. When employing filters according to the invention, there will be realized an effective purification of the waste gases. An otherwise required device for purifying the gases outside the combustion chambers will not be needed.

A further advantage of the device for purifying the gases, which consists primarily of the filters arranged in the post-combustion chamber, consists in that the particles floating in the waste gases are retained in the still hot region of the post-combustion chamber whereby in case that the ash particles still contain combustible components, a further post-combustion will be realized. For instance, filter mats having a thickness of approximately from 10 to 15 mm and pressed out of fibers having a thickness of approximately 0.003 mm may be employed. The volumetric weight of the filter mats amounts to be employed. The volumetric weight of the filter mats amounts to approximately 200 kg/m$^3$. The fibers consist of equal parts of $SiO_2$ and $Al_2O_3$. They are temperature resistant up to approximately 1500° C. Experience has proved that the filter mats regenerate themselves due to the fact that the ashes, when reaching a certain layer thickness scale off in the form of little plates. Also the filter material scales off in thinner layers and drops into the post-combustion chamber. When the filter mats have been worn or are used up to a considerable extent, it has proved expedient to crush the same without removing them from the combustion chamber. The thus obtained parts of the filter mats are dropped into the post-combustion chamber. These parts of the filter mats are then together with the ashes on the bottom of the post-combustion chamber withdrawn from the combustion chamber. To this end, the bottom of the post-combustion chamber is provided with a downwardly extending flap which at its inner side is covered by a fire-resistant material such as fireproof clay. New filter mats are then from the outside inserted into the post-combustion chamber. In this way, even if radioactive waste is being burned, a danger-free servicing of the plate by the servicing personnel is possible.

In order to hold the filter mats during the operation of the plant on the inside of the outer wall without employing a complicated and/or expensive holding means, it has proved expedient when the part of the outer wall which part contains the outlets of the waste gases, is designed as a grate of steel, or the like, or is designed as orifice plates of ceramic material. Inasmuch as during the operation expediently a pressure below atmospheric pressure is maintained in the plant, the filter mats are pressed against the outer wall and are in this way in their respective position.

BRIEF DESCRIPTION OF THE DRAWING

The FIGURE shown on the drawing is a sectional elevation of the plant for burning waste.

Referring now to the drawing in detail, the plant illustrated therein, comprises a main combustion chamber 1, a post-combustion chamber 2 arranged below said main combustion chamber 1, and a device for purifying the waste gases. This device consists primarily of the filter mats 3 of ceramic material which filter mats are arranged within said post-combustion chamber 2. The main combustion chamber 1 and the post-combustion chamber 2 are separated from each other by a grate 4. The volume of the post-combustion chamber amounts to about twice the volume of the main combustion chamber.

As will furthermore be seen from the drawing, the post-combustion chamber is designed as a combustion chamber which is adapted to be closed toward the bottom by a flap 5. In the outer wall 6 of the post-combustion chamber there are provided ceramic perforated plates 7, the perforations of which simultaneously form the outlets for the waste gases. The waste gases are outside the post-combustion chamber conveyed in the waste gas conduit 8. As will likewise be seen from the drawing, within the post-combustion chamber 2 there is arranged an inner wall 9 extending into said post-combustion chamber 2. The arrangement is such that the flue gases passing from above through the grate 4 are conveyed to the bottom of the post-combustion chamber 2 on which there are provided the ash particles passing through the grate 4. At the bottom, the gases are, in the direction indicated by the arrows, discharged below the inner wall 9 into the space between inner wall 9 and the outer wall, and from there through the filter mats 3 and the outlets.

Guiding plates are arranged below the grate 4 which is designed as a two-sectional pivotable grate. These guiding plates bring about a constriction of the post-combustion chamber 2 and thus bring about a whirling of the flue gases coming in from above. Below the guiding plates 11 there is provided the mouth of the delivery for the fresh gases directed to the post-combustion chamber 2. This delivery, as will be evident from the direction of the arrows shown in the drawing arranged within the inner wall 9 in the form of a delivery is guided in countercurrent flow. This delivery of the fresh gases conveyed to the main combustion chamber is arranged in the wall of the main combustion chamber designed as double wall in such a way that the fresh gases are conveyed in the double wall in the direction from below upwardly to the mouth of the delivery arranged in the upper portion. Both deliveries are fed from a common annular passage 12 which is connected to a feeding line 13 with a heater 14. The delivery of fresh gases to the post-combustion chamber can be varied by controlling a flat slide valve 15.

For purposes of charging the main combustion chamber 1, the waste materials are conveyed into a charging box 16 and from there, in conformity with the need and the corresponding condition of the firing system are conveyed through the filling chute 17 into the main combustion chamber 1. The condition of the firing system can be observed at any time through the side window 18. A check valve flap 19 prevents that during detonations or explosions or when introducing easily inflatable substances, waste gases pass into the charging box 16. Furthermore, in the charging shaft 17 a valve 20 is provided which will prevent that during explosion-like combustions, parts of the waste materials are thrown upwardly. In order to avoid damage to the plant by an instantaneous pressure increase, a waste gas conduit 21 is provided with a flap 22 which (not illustrated in the drawing) is connected to the waste gas conduit of the plant. During normal operation of the plant in which a pressure below atmospheric pressure prevails in the combustion chambers, the flap 21 is closed by the pressure acting thereupon from the outside.

As will likewise be seen from the drawing, the outer wall 6 of the post-combustion chamber is offset relative to the outer wall of the main combustion chamber and is arranged in such a way that worn or used-up filter mats 3 can after removal of a stopper 23 be crushed from above. The thus formed particles of the filter mat drop onto the bottom of the post-combustion chamber 2 and after opening the flap 5 are with the ashes conveyed into a steel vat 24 which is arranged below the post-combustion chamber 2 and is closely connected thereto. In view of this arrangement, the servicing personnel will not come into touch with the residues formed during the combustion.

Due to the fact that the filling shaft or chute 17, the main combustion chamber 1, the post-combustion chamber 2, and the steel vat 24 arranged vertically one above the other and furthermore due to the fact that the two parts of the pivotal grate 4 can be pivoted toward the side and thus free the passage, it will be appreciated that with the flap 5 in opened condition the entire plant can be easily cleaned. This is of particular importance, when clogged-up areas have to be opened up again.

Experience has shown that with suitable charging of the plant according to the invention, also if wastes with a heating value of from only 2000 to 3000 Kcal/Kg are burned, it is possible in the post-combustion chamber to realize temperatures of about 900° C without the necessity of providing additional heating means for the fresh gases. The temperature prevailing of the post-combustion chamber will then be about 200° higher than the temperature in the main combustion chamber. As has furthermore been found, the still burnable component in the ashes obtained after a combustion is less than 1%.

As filter mats are preferably used ceramic fibers known under the commercial name "Ceraform board", for fire resistant insulation. For purposes of checking the purity of waste gases discharged from the post-combustion chamber and purified by the employment of filter mats, an absolute filter was inserted into the waste gas conduit. The cutoff of the absolute filter amounted to 99.996% relative to radioactive air aerosols with a particle diameter of 0.3$\mu$ (quality classification S). After approximately 40 hours of operation, an increase in the differential pressure on the absolute filter of 10 mm was measured.

It is, of course, to be understood that the present invention is, by no means, limited to the specific showing in the drawing, but also comprises any modifications within the scope of the appended claims.

What we claim is:

1. A plant for burning waste, which includes: a main combustion chamber having inlet means for receiving waste to be burned and for receiving fresh gases for burning said waste, a post-combustion chamber arranged below said main combustion chamber and open at its top, means for normally providing a down draft through the main combustion chamber into said post-combustion chamber and including therewith a grate interposed between said main combustion chamber and said post-combustion chamber and forming the bottom of said main combustion chamber and the top of said post-combustion chamber, said post-combustion chamber having an opening in its bottom for discharging ashes and residues from the combustion in said main and post-combustion chambers and having a volume equalling at least the volume of said main combustion chamber, cover means for selectively closing said opening, said post-combustion chamber also being provided with outlet means for discharging waste gas from said post-combustion chamber and a wall structure of highly heat resistant material arranged within said post-combustion chamber and open at its bottom for guiding flue gases passing through said grate toward the bottom of said post-combustion chamber.

2. A plant according to claim 1, which includes restricting guiding plates arranged in the upper portion of the space defined by the inside of said wall structure for subjecting to turbulence the gases passing into said post-combustion chamber.

3. A plant according to claim 1, which includes conduit means leading into the upper portion of the space defined by the inside of said wall structure.

4. A plant according to claim 2, which includes conduit means for conveying fresh gases into said post-combustion chamber, said conduit means leading into said post-combustion chamber below said guiding plates.

5. A plant according to claim 4, in which a portion of said conduit means leading into said post-combustion chamber extends in countercurrent flow direction with regard to the downward flow direction of the gases passing through said grate.

6. A plant according to claim 1, in which the wall of said main combustion chamber is a double wall with its inner wall consisting of a highly heat-resistant material, and in which said inlet means for feeding fresh gases into said main combustion chamber leads into the upper portion of said main combustion chamber and is so arranged therein that said last mentioned fresh gas passes between said inner and outer walls of said double wall in upward direction prior to entering the chamber defined by said last mentioned inner wall.

7. A plant according to claim 1, in which said grate comprises at least two sections each of which is pivotable about one but a different axis toward the respective adjacent wall of said main combustion chamber.

8. A plant according to claim 7, in which the grate sections are provided with intermeshing teeth.

9. A plant according to claim 1, which includes waste gas filtering means arranged in said outlet means of said post-combustion chamber.

10. A plant according to claim 9, in which said waste gas filtering means include filtering mats of ceramic material arranged in said outlet means.

11. A plant according to claim 1, in which a portion of said outlet means of said post-combustion chamber is formed by the outer wall of said post-combustion chamber and is formed as a grate of steel.

12. A plant according to claim 1, in which a portion of said outlet means of said post-combustion chamber is formed by the outer wall of said post-combustion chamber and is formed as perforated plates of ceramic material.

* * * * *